US008398076B2

(12) United States Patent
Bernard et al.

(10) Patent No.: US 8,398,076 B2
(45) Date of Patent: Mar. 19, 2013

(54) LOW-NOISE MAILPIECE STORAGE DEVICE

(75) Inventors: Emmanuel Bernard, Sannois (FR); Stéphane Le Gallo, Savigy sur Orge (FR)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 13/337,435

(22) Filed: Dec. 27, 2011

(65) Prior Publication Data

US 2012/0193866 A1 Aug. 2, 2012

(30) Foreign Application Priority Data

Jan. 28, 2011 (EP) ..... 11305090

(51) Int. Cl.
*B65H 31/06* (2006.01)

(52) U.S. Cl. ..... 271/216; 271/2; 271/181; 414/798.2

(58) Field of Classification Search ..... 271/207, 271/224, 177, 216, 181, 184, 185, 2; 414/798.2, 414/792.7

See application file for complete search history.

(56) References Cited

U.S. PATENT DOCUMENTS

| | | | | | |
|---|---|---|---|---|---|
| 1,581,583 | A * | 4/1926 | Low | 271/184 |
| 3,907,128 | A * | 9/1975 | Cathers | 414/788.9 |
| 3,974,626 | A * | 8/1976 | Getsch | 53/244 |
| 4,201,377 | A * | 5/1980 | Honegger | 271/225 |
| 5,137,415 | A * | 8/1992 | Doeberl et al. | 414/798.5 |
| 5,186,452 | A * | 2/1993 | Holbrook | 271/216 |
| 5,464,317 | A * | 11/1995 | Foster et al. | 414/798.2 |
| 5,615,995 | A * | 4/1997 | Nobile et al. | 414/798.2 |
| 6,817,608 | B2 * | 11/2004 | Sloan et al. | 271/216 |
| 7,758,043 | B2 * | 7/2010 | Keller | 271/225 |
| 8,256,765 | B2 * | 9/2012 | Desire | 271/216 |
| 2005/0133987 | A1 * | 6/2005 | Asano | 271/207 |
| 2010/0258406 | A1 | 10/2010 | Desire | |
| 2012/0027554 | A1 * | 2/2012 | Lee | 414/788.9 |

FOREIGN PATENT DOCUMENTS

| | | | |
|---|---|---|---|
| DE | 1189462 | B | 3/1965 |
| JP | 61-101557 | U | 6/1986 |

* cited by examiner

*Primary Examiner* — Kaitlin Joerger

(74) *Attorney, Agent, or Firm* — Sughrue Mion, PLLC

(57) ABSTRACT

A storage device for a mail-handling machine, said storage device comprising a mailpiece-receiving deck along a longitudinal edge of which a referencing wall extends, and through which a conveyor belt passes for the purpose of conveying mailpieces along said referencing wall, and a shock-absorber ramp that is mounted against the referencing wall and that is hit by the mailpieces after they are ejected from said mail-handling machine, and before they fall back down onto the conveyor belt so as to be conveyed towards the sloping surface.

10 Claims, 2 Drawing Sheets

LOW-NOISE MAILPIECE STORAGE DEVICE

FIELD OF THE INVENTION

The present invention relates to the field of mail-handling and it relates more particularly to a storage device for a mail-handling machine.

PRIOR ART

Current mail-handling machines are increasingly fast, and such high franking rates require their feed and storage capacities to be increased in order to avoid the operator constantly needing to load and unload the machine. However, this increase in the feed and storage capacity must not be achieved to the detriment of the amount of space that needs to be dedicated to the franking machine or "postage meter".

The Applicant has therefore made improvements to storage devices (or stackers) so that they address that problem, in particular in US Patent Application US 2010/258406 or in the European Patent Application filed the same day as the present application and entitled "Dispositif de stockage sur champ d'articles de courrier" ("A device for storing mailpieces on edge"). U.S. Pat. No. 5,615,995, DE1189492, and JP61101557 also show improved storage devices.

Although those devices are significantly more suitable for handling envelopes than the other existing devices, they do still suffer from certain drawbacks, in particular in terms of positioning or of noise, and, when they are required to handle labels ejected by the mail-handling machine, in terms of jamming. When the storage device is disposed at 90° relative to the mail-handling machine, the envelopes ejected at high speed bounce off the referencing wall (or "jogging" wall) and arrive askew on the motor-driven belt, thereby adversely affecting how well those envelopes are stood up on edge and therefore how well they accumulate. In addition, in such a configuration, the envelopes hitting the wall generate a relatively high noise level. Similarly, when handling labels, and when the storage device is aligned with the mail-handling machine, labels exiting from the machine fall between the motor-driven belt and the referencing wall, and are then not driven and accumulate at the inlet of the device, thereby jamming it.

OBJECT AND SUMMARY OF THE INVENTION

The present invention proposes to mitigate the above-mentioned drawbacks by providing a storage device for a mail-handling machine, said storage device comprising a mail-piece-receiving deck along a longitudinal edge of which a referencing wall extends, and through which a conveyor belt passes for the purpose of conveying mailpieces along said referencing wall, said storage device further comprising a shock-absorber wedge disposed in the angle formed by said mail-receiving deck and said referencing wall, and that is hit by the mailpieces after they are ejected from said mail-handling machine, and before they fall back down onto the conveyor belt so as to be conveyed towards said sloping surface.

Thus, by means of this simple shock-absorbing element (advantageously made of a hard and low-friction plastics material), the envelopes find themselves correctly positioned on the conveyor belt and the operating noise is significantly reduced. In addition, by sliding naturally onto the conveyor belt, the labels prevent any jamming at the inlet of the device.

Preferably, said shock-absorber wedge is a right prism based on a right triangle and having a first side face, a second side face perpendicular to the first side face, and a third side face interconnecting said first and second faces.

Advantageously, said first side face has a heel for resting on said mailpiece-receiving deck, and said heel forms substantially ⅓ of the total width of said first side face.

Preferably, said second side face has an adhesive or magnetic zone for fastening it to said referencing wall, and said third face has a concave shape that has tangents to the vertices that form angles $\phi_1$ and $\phi_2$, identical or otherwise, lying in the range 20° to 25°.

Advantageously, said shock-absorber wedge extends over a length corresponding to no less than the length of a standard label, typically about 110 millimeters (mm), and it extends over a width corresponding to no less than the maximum envelope flap width, typically about 50 mm.

BRIEF DESCRIPTION OF THE DRAWINGS

Other characteristics and advantages of the present invention appear more clearly from the following description given by way of non-limiting indication and with reference to the accompanying drawings, in which.

DESCRIPTION OF EMBODIMENTS

Figure 1:
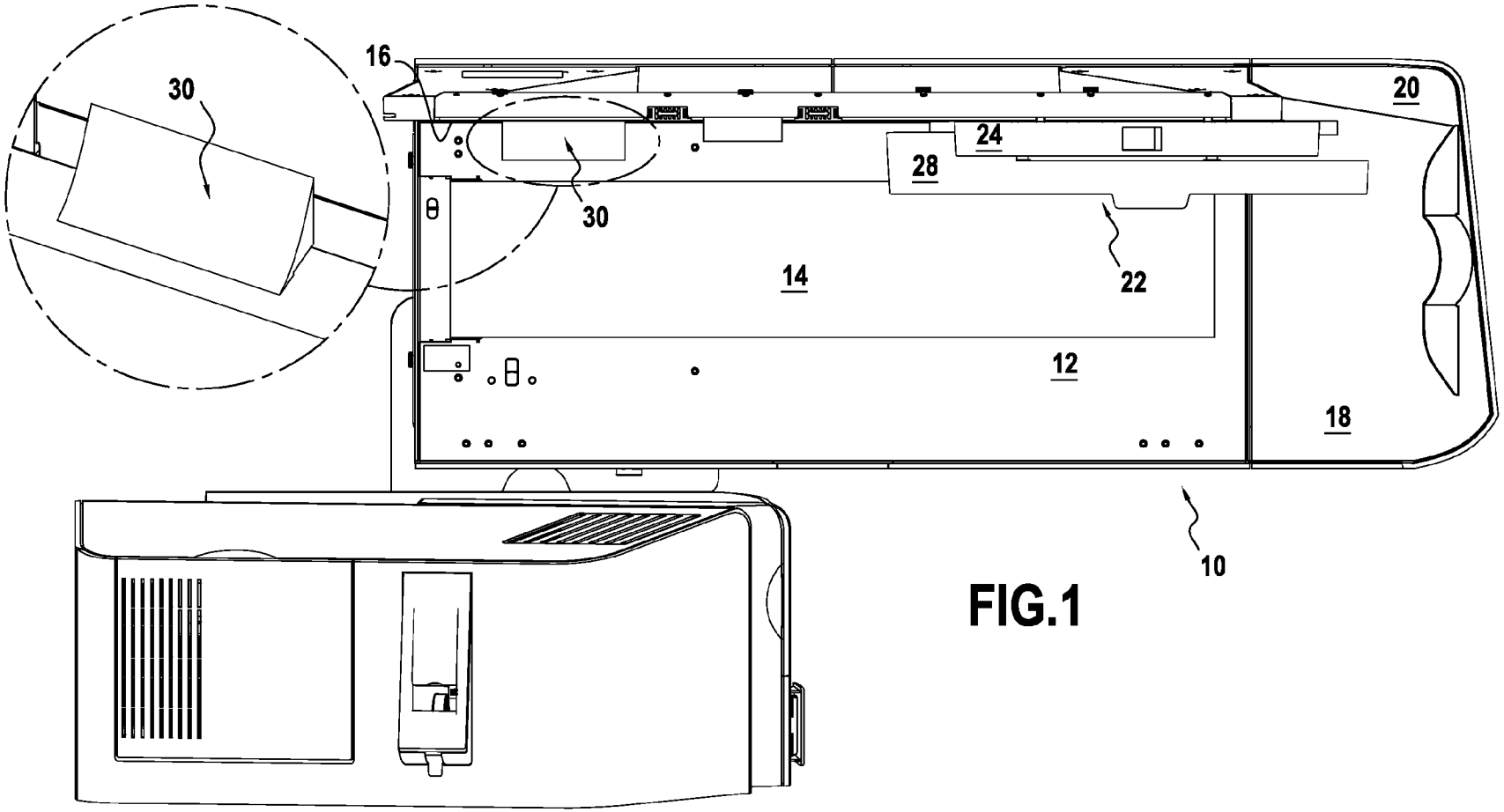
FIG. 1 is a view from above of a storage device of the invention that is fed at 90° from a mail-handling machine.

FIG. 1 shows a storage device 10 that, in conventional manner, includes a rectangular mailpiece-receiving deck 12 through which a conveyor belt 14 passes that extends over the entire length of the deck along a longitudinal referencing wall 16, the end of the deck that is opposite from its end at the inlet of the device being formed by a sloping surface 18. The angle formed by the sloping surface and by the mailpiece-receiving deck is preferably about 45° plus or minus 10°. Continuity between the longitudinal wall and the sloping surface is provided by a link plate 20.

It should be noted that, in order to facilitate laterally jogging the mailpieces, the mailpiece-receiving deck and the referencing wall that form an angle of 90° between them are advantageously inclined backwards (i.e. going away from the operator) by a few degrees relative to the horizontal. It should also be noted that, in conventional manner, since the conveyor belt 14 is dimensioned for handling standard envelopes (dimensioning that accommodates all formats would give rise to costs that are too high), it does not extend over the entire width of the mailpiece-receiving deck (i.e. about 300 mm), but rather it extends over about ⅔ of said width (i.e. 200 mm), and that it does not come flush with the referencing wall 16, but rather it is spaced apart therefrom by a maximum flap width, i.e. about 50 mm, so as to prevent the flaps of the envelopes from catching under the belt, which would give rise to jams.

The device may also include a pivot arm (not shown) that is mounted to move both vertically about a hinge pin fastened in a manner such that it extends perpendicularly to the referencing wall, and also horizontally along a slide rail fastened to the referencing wall, and on which pivot arm a set of friction rollers and advantageously a holding roller are mounted, making it possible to increase the storage capacity of the stack by compressing it against the sloping surfaces, and, for mailpieces of large thickness, making it possible to arch said mailpieces and thus to facilitate incorporating them into the stack.

Figure 2:
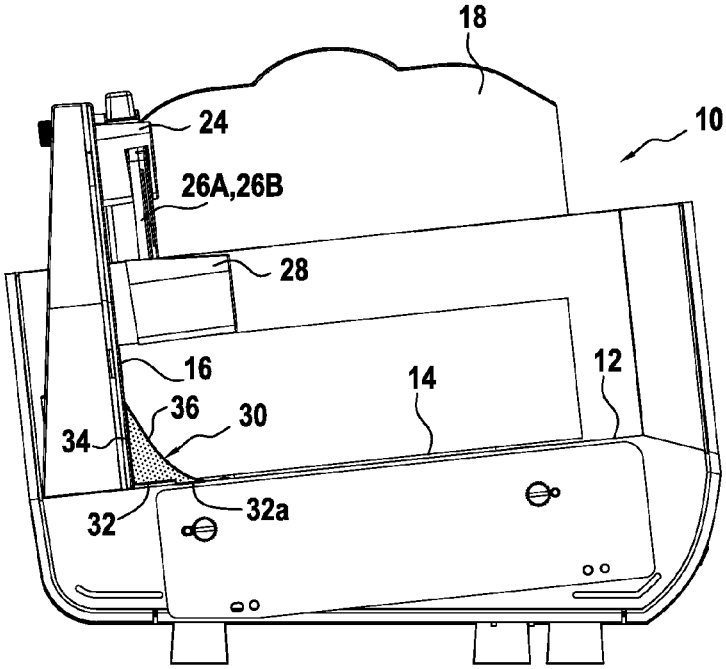
FIG. 2 is an end view of the storage device of FIG. 1.
Figure 3A:
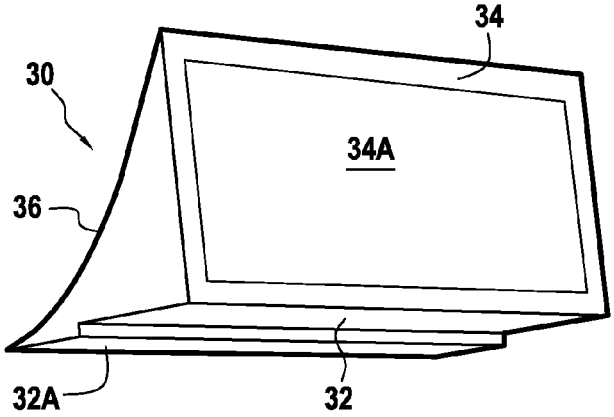
FIGS. 3A and 3B are views in perspective and in section of a shock-absorber wedge of the storage device of FIG. 1.
Figure 3B:
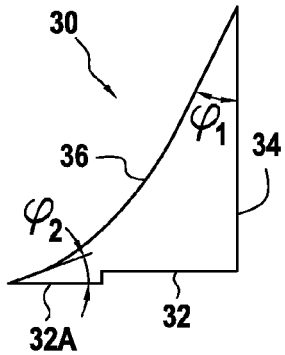

In order to jog the top of the stack of mailpieces, the device further includes a mechanism 22 having a structure 24 secured to the device and supporting, e.g. by means of two hinged support arms 26A, 26B (coupling by means of a single arm is naturally also possible), a deployable/retractable skid-forming part 28 that comes to press on the top of the stack of mailpieces, substantially over the entire length of said stack. The skid-forming part may, for example, take up two distinct positions depending on the format of said mailpieces, namely a low position, as shown in FIG. 2, and a high position into which said part rises until it comes to the same level as the structure.

In accordance with the invention, the storage device further includes a right prism forming a shock-absorber wedge 30 disposed in the angle formed by the mailpiece-receiving deck 12 and by the referencing wall 16, and advantageously extending from the inlet of the storage device, or not far therefrom (e.g. 70 mm therefrom, thereby making it possible to center mailpieces of business card format exiting directly from the franking machine), over a distance corresponding to no less than the length of a standard label, i.e. about 110 mm, and over a width such that the wedge does not cover the conveyor belt 14, typically about 40 mm for a belt disposed at 50 mm from the referencing wall. This prism based on a right triangle rests on the mailpiece-receiving deck via a heel 32A of a first one 32 of its three side faces, and is placed against the referencing wall via a second side face 34 that is perpendicular to the first side face, the sloping third and last side face 36 that interconnects the preceding two side faces having a concave, slightly dished, shape, with tangents to the vertices forming angles $\phi_1$ and $\phi_2$ that may be identical or otherwise, lying in the range 20° to 25°.

The heel 32A of the first side face 32 forms substantially ⅓ of its total width, the remaining portion acting as a bevel for enabling the prism to be properly positioned in the 90° angle formed by the mailpiece-receiving deck and by the referencing wall, in view of the manufacturing tolerances of the various elements involved. The second side face 34 has a zone 34A for fastening the shock-absorber wedge to the device, which zone may be adhesive or magnetic depending on the type of the referencing wall, i.e. depending whether it is made of plastics material or of metal, respectively. Finally the shock-absorbing function of the wedge is enhanced by the nature of its material, which is advantageously a hard and low-friction plastics material of the following type or of some other type: polypropylene (PP), polyamide (PA), or acrylonitrile butadiene styrene/polycarbonate (ABS/PC).

The device operates as follows. At rest, the skid-forming part is, depending on the format of the mailpieces to be stored, either in the low position or in the high position. When a first mailpiece is ejected from the mail-handling machine at 90° onto the mailpiece-receiving deck 12, it comes into contact with the slope of the shock-absorber wedge and it rises thereon until the kinetic energy of the mailpiece is zero, and then it slides back down said slope until it reaches the conveyor belt 14. The wedge thus absorbs the impact of the mailpiece against the referencing wall and then positions it on the conveyor belt, always in the same manner (the effect of random bouncing that exists in prior art devices is thus avoided) before it is conveyed flat towards the sloping surface 18 that stands it up. The process then continues with the second mailpiece and then with the following mailpieces that accumulate on one another. By means of the presence of the skid-forming part, the top of the stack is jogged properly, thereby making the stack more uniform during storage. In addition, the bias exerted by the skid on the top of the stack, by increasing the grip of the mailpieces on the conveyor belt, compresses the stack and increases the storage capacity of the device, while preventing said stack from collapsing.

It should be noted that in in-line operation in which the storage device is aligned on the mail-handling machine, the presence of the shock-absorber wedge makes it possible to handle labels without jamming, because, instead of falling into the space with no motor drive between the referencing wall and the conveyor belt, and accumulating in said space until they saturate prior art devices, they fall onto the shock-absorber wedge that, due to its slope, causes them to slide onto the conveyor belt, thereby avoiding any jam at the inlet of the storage device.

Thus, with the present invention, a storage device is obtained that is simple, that is usable in various configurations, and in which the operating noise due to impacts is reduced and jamming is reduced.

What is claimed is:

1. A storage device for a mail-handling machine, said storage device comprising a mailpiece-receiving deck along a longitudinal edge of which a referencing wall extends, and through which a conveyor belt passes for the purpose of conveying mailpieces along said referencing wall towards a sloping surface against which said mailpieces accumulate, said storage device further comprising a shock-absorber wedge disposed in the angle formed by said mail-receiving deck and said referencing wall, and that is hit by the mailpieces after they are ejected from said mail-handling machine, and before they fall back down onto the conveyor belt so as to be conveyed towards said sloping surface.

2. A storage device according to claim 1, said shock-absorber wedge being a right prism based on a right triangle and having a first side face, a second side face perpendicular to the first side face, and a third side face interconnecting said first and second faces.

3. A storage device according to claim 1, said shock-absorber wedge being made of a hard and low-friction polymer.

4. A storage device according to claim 2, said first side face having a heel for resting on said mailpiece-receiving deck.

5. A storage device according to claim 4, wherein said heel of said first side face forms substantially ⅓ of the total width of said first side face.

6. A storage device according to claim 2, said second side face having an adhesive or magnetic zone for fastening it to said referencing wall.

7. A storage device according to claim 2, said third face having a concave shape.

8. A storage device according to claim 2, said third side face of concave shape having tangents to the vertices that form angles $\phi_1$ and $\phi_2$, identical or otherwise, lying in the range 20° to 25°.

9. A storage device according to claim 1, said shock-absorber wedge extending over a length corresponding to no less than the length of a label, typically about 110 mm.

10. A storage device according to claim 1, said shock-absorber wedge extending over a width corresponding to no less than the maximum envelope flap width, typically about 40 mm.

* * * * *